US010124576B2

(12) United States Patent
Lestrange et al.

(10) Patent No.: US 10,124,576 B2
(45) Date of Patent: Nov. 13, 2018

(54) CONTAMINATION-PROOF IMAGING MEMBER CLEANING DEVICE AND METHOD

(71) Applicant: XEROX CORPORATION, Norwalk, CT (US)

(72) Inventors: Jack T. Lestrange, Macedon, NY (US); Peter J. Knausdorf, Henrietta, NY (US); Anthony S. Condello, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 15/474,812

(22) Filed: Mar. 30, 2017

(65) Prior Publication Data

US 2018/0281380 A1 Oct. 4, 2018

(51) Int. Cl.
*B41F 35/06* (2006.01)
*B41F 7/02* (2006.01)

(52) U.S. Cl.
CPC ..... *B41F 35/06* (2013.01); *B41F 7/02* (2013.01)

(58) Field of Classification Search
CPC ..... B41F 35/06
USPC ..... 101/425
See application file for complete search history.

(56) References Cited

U.S. PATENT DOCUMENTS 3,871,081 A * 3/1975 Inoue ..... G03G 21/0041 101/425
6,536,876 B1 * 3/2003 Fotland ..... B41J 2/01 347/55
7,281,790 B2 * 10/2007 Mouri ..... B41J 2/0057 347/102
9,771,653 B2 * 9/2017 Zhang ..... G03G 21/0088
2004/0234309 A1 * 11/2004 Nagata ..... G03G 15/161 399/348
2011/0132213 A1 * 6/2011 DeJoseph ..... B41C 1/1066 101/130
2012/0103212 A1 5/2012 Stowe et al.
2012/0103221 A1 5/2012 Stowe et al.
2013/0064591 A1 * 3/2013 Salalha ..... G03G 15/104 399/357
2014/0169826 A1 * 6/2014 Higaki ..... G03G 15/0258 399/100
2014/0356041 A1 * 12/2014 Ota ..... G03G 21/0011 399/349

* cited by examiner

*Primary Examiner* — Anthony Nguyen
(74) *Attorney, Agent, or Firm* — Caesar Rivise, PC

(57) ABSTRACT

A cleaning apparatus includes an inker roller and an ink source holding ink for the inker roller. The inker roller contacts a reimageable surface of an imaging member downstream of an ink image transfer station that transfers an ink image from the surface to a print sheet, with the surface having residual ink remaining thereon after the transfer of the ink image. The inker roller applies ink from the ink source against the reimageable surface. However, instead of the ink transferring from the inker roller to the surface, the ink stays with the inker roller and removes the residual ink from the surface to clean the surface for a subsequent ink image. The inker roller is not contaminated from removing the residual ink as the inker roller is designed to be coated by ink that adds to its coating of ink via the removed residual ink.

20 Claims, 3 Drawing Sheets

CONTAMINATION-PROOF IMAGING MEMBER CLEANING DEVICE AND METHOD

FIELD OF DISCLOSURE

This invention relates generally to ink-based digital printing systems, and more particularly, to variable lithographic imaging member cleaning systems having a residual ink imaging member cleaning prior to a subsequent printing.

BACKGROUND

Conventional lithographic printing techniques cannot accommodate true high-speed variable data printing processes in which images to be printed change from impression to impression, for example, as enabled by digital printing systems. The lithography process is often relied upon, however, because it provides very high quality printing due to the quality and color gamut of the inks used. Lithographic inks are also less expensive than other inks, toners, and many other types of printing or marking materials.

Ink-based digital printing uses a variable data lithography printing system, or digital offset printing system, or a digital advanced lithography imaging system. A "variable data lithography system" is a system that is configured for lithographic printing using lithographic inks and based on digital image data, which may be variable from one image to the next. "Variable data lithography printing," or "digital ink-based printing," or "digital offset printing," or digital advanced lithography imaging is lithographic printing of variable image data for producing images on a substrate that are changeable with each subsequent rendering of an image on the substrate in an image forming process.

For example, a digital offset printing process may include transferring radiation-curable ink onto a portion of an imaging member (e.g., fluorosilicone-containing imaging member, imaging blanket, printing plate) that has been selectively coated with a dampening fluid layer according to variable image data. According to a lithographic technique, referred to as variable data lithography, a non-patterned reimageable surface of the imaging member is initially uniformly coated with the dampening fluid layer. Regions of the dampening fluid are removed by exposure to a focused radiation source (e.g., a laser light source) to form pockets. A temporary pattern in the dampening fluid is thereby formed over the printing plate. Ink applied thereover is retained in the pockets formed by the removal of the dampening fluid. The inked surface is then brought into contact with a substrate at a transfer nip and the ink transfers from the pockets in the dampening fluid layer to the substrate. The dampening fluid may then be removed, a new uniform layer of dampening fluid applied to the printing plate, and the process repeated.

Digital printing is generally understood to refer to systems and methods of variable data lithography, in which images may be varied among consecutively printed images or pages. "Variable data lithography printing," or "ink-based digital printing," or "digital offset printing" are terms generally referring to printing of variable image data for producing images on a plurality of image receiving media substrates, the images being changeable with each subsequent rendering of an image on an image receiving media substrate in an image forming process. "Variable data lithographic printing" includes offset printing of ink images generally using specially-formulated lithographic inks, the images being based on digital image data that may vary from image to image, such as, for example, between cycles of an imaging member having a reimageable surface. Examples are disclosed in U.S. Patent Application Publication No. 2012/0103212 A1 (the '212 Publication) published May 3, 2012 based on U.S. patent application Ser. No. 13/095,714, and U.S. Patent Application Publication No. 2012/0103221 A1 (the '221 Publication) also published May 3, 2012 based on U.S. patent application Ser. No. 13/095,778. These applications are commonly assigned.

Digital offset printing inks differ from conventional inks because they must meet demanding rheological requirements imposed by the variable data lithographic printing process while being compatible with system component materials and meeting the functional requirements of subsystem components, including wetting and transfer where the imaging member surface supports an image that is only printed once and is then refreshed. Each time the imaging member transfers its image to the print media or substrate, all history of that image remaining on the imaging member surface must be eliminated to avoid ghosting. Inevitably some film-splitting of the ink occurs at the transfer nip such that complete ink transfer to the print media cannot be guaranteed as residual ink may remain. This problem is a long felt need in the digital offset printing industry, with these systems requiring cleaning subsystems after the transfer nip to continuously remove post transfer residual ink from the reimageable surface of the imaging member prior to formation of the next print image. The inventors, aided by careful empirical testing and materials analysis, found and prescribe specific materials and system layout guidelines for more efficient and effective residual ink removal.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing a cleaning apparatus having an inker roller and an ink source holding ink for the inker roller. The inker roller contacts a reimageable surface of an imaging member downstream of an ink image transfer station that transfers an ink image from the reimageable surface to a print sheet, with the reimageable surface of the imaging member having residual ink remaining thereon after the transfer of the ink image. The inker roller applies ink from the ink source against the reimageable surface. However, instead of the ink transferring from the inker roller to the reimageable surface, the ink stays with the inker roller and removes the residual ink from the reimageable surface to clean the surface for a subsequent ink image. The inker roller is not contaminated from picking up the residual ink when the ink in the ink source and the ink image are the same.

According to aspects described herein, an ink-based digital printing system includes an imaging member having a reimageable surface, and ink delivery device, an ink image transfer station and a second ink delivery device. The ink delivery device includes a first ink source, with the ink delivery device configured to deposit a first ink over the reimageable surface to form an ink image. The ink image transfer station is positioned downstream of the ink delivery device in a printing process direction and transfers the ink image from the reimageable surface to an image receiving print sheet, with the reimageable surface having residual ink remaining on the surface after the transfer of the formed ink image. The second ink delivery device may be in rolling contact with the reimageable surface of the imaging member downstream of the ink image transfer station in the printing process direction. The second ink delivery device includes a second ink source, with the second ink delivery device configured to remove the residual ink from the reimageable surface by carrying a second ink from the second ink source to the imaging member and contacting the second ink against the residual ink to clean the reimageable surface.

According to aspects illustrated herein, an ink-based digital printing cleaning method includes depositing ink over a reimageable surface of an imaging member with an ink delivery unit to form an ink image, transferring the ink image from the reimageable surface to an image receiving print sheet via an ink image transfer station positioned downstream of the ink delivery unit in a printing process direction, the reimageable surface having residual ink remaining on the surface after the transfer of the formed ink image, delivering ink against the reimageable surface of the imaging member with an inked inker roller downstream of the ink image transfer station in the printing process direction, and removing the residual ink off of the reimageable surface with the ink on the inker roller to clean the surface.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

The terms "print media", "print substrate", "print sheet" and "sheet" generally refers to a usually flexible physical sheet of paper, polymer, Mylar material, plastic, or other suitable physical print media substrate, sheets, webs, etc., for images, whether precut or web fed.

The term "printing device", "imaging machine" or "printing system" as used herein refers to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

The 212 Publication proposes systems and methods for providing variable data lithographic and offset lithographic printing or image receiving medium marking. The systems and methods disclosed in the 212 Publication are directed to improvements on various aspects of previously-attempted variable data digital imaging lithographic marking concepts based on variable patterning of fountain solutions (e.g., dampening fluids) to achieve effective truly variable digital data lithographic image forming. It should be noted that dampening fluid and fountain solution may be referred to interchangeably herein.

Figure 1:
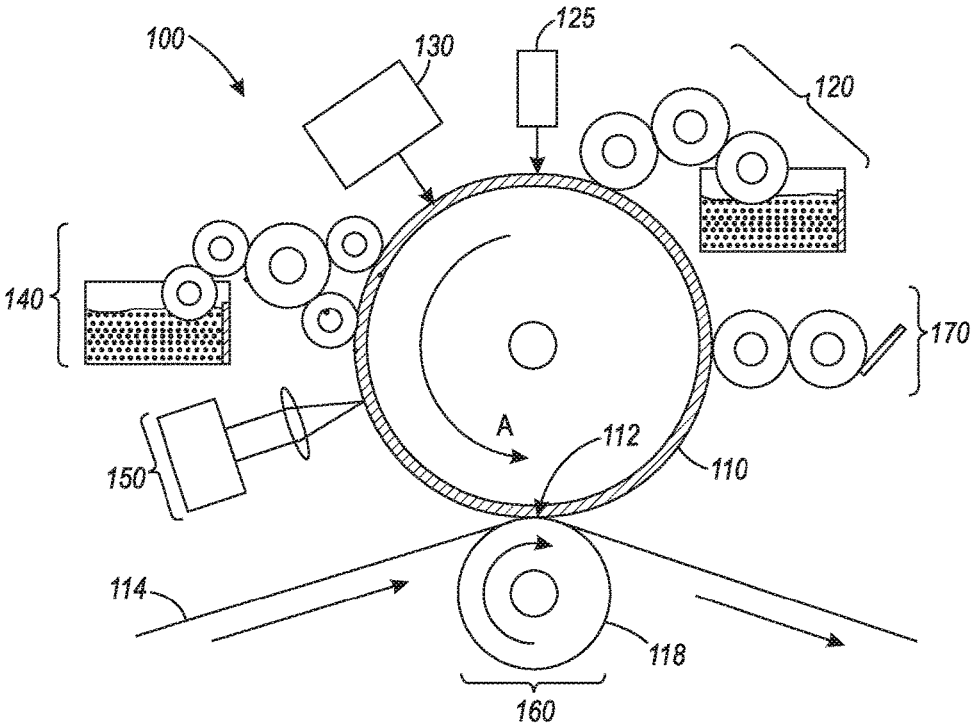
FIG. 1 Related Art
FIG. 1 is a side view of a related art variable lithographic printing system.

The 212 Publication describes, in requisite detail, an exemplary variable data lithography system 100 such as that shown, for example, in FIG. 1. A general description of the exemplary system 100 shown in FIG. 1 is provided here. Additional details regarding individual components and/or subsystems shown in the exemplary system 100 of FIG. 1 may be found in the 212 Publication.

As shown in FIG. 1, the exemplary system 100 may include an imaging member 110. The imaging member 110 in the embodiment shown in FIG. 1 is a drum, but this exemplary depiction should not be read in a manner that precludes the imaging member 110 being a plate or a belt, or of another known configuration. The imaging member 110 is used to apply an inked image to an image receiving media substrate 114 at a transfer nip 112. The transfer nip 112 is produced by an impression roller 118, as part of an image transfer mechanism 160, exerting pressure in the direction of the imaging member 110. Image receiving medium substrate 114 should not be considered to be limited to any particular composition such as, for example, paper, plastic, or composite sheet film. The exemplary system 100 may be used for producing images on a wide variety of image receiving media substrates. The 212 Publication also explains the wide latitude of marking (printing) materials that may be used, including marking materials with pigment densities greater than 10% by weight. As does the 212 Publication, this disclosure will use the term ink to refer to a broad range of printing or marking materials to include those which are commonly understood to be inks, pigments, and other materials which may be applied by the exemplary system 100 to produce an output image on the image receiving media substrate 114.

The 212 Publication depicts and describes details of the imaging member 110 including the imaging member 110 being comprised of a reimageable surface layer 112 formed over a structural mounting layer that may be, for example, a cylindrical core, or one or more structural layers over a cylindrical core. The reimageable surface 115 may be formed of a relatively thin layer over the mounting layer, a thickness of the relatively thin layer being selected to balance printing or marking performance, durability and manufacturability.

The exemplary system 100 includes a dampening fluid subsystem 120 that may have a series of rollers for uniformly wetting the reimageable surface 115 with a uniform layer of a dampening fluid, with a thickness of the layer being controlled. The dampening fluid may comprise water optionally with small amounts of isopropyl alcohol or ethanol added to reduce surface tension as well as to lower evaporation energy necessary to support subsequent laser patterning, as will be described in greater detail below. Experimental investigation has also shown low surface energy solvents such as volatile silicone oils can serve as dampening fluids, as well.

Once the dampening fluid is metered onto the reimageable surface 115, a thickness of the layer may be measured using a sensor 125 that may provide feedback to control the metering of the dampening fluid onto the reimageable surface by the dampening fluid subsystem 120.

Once a precise and uniform amount of dampening fluid is provided by the dampening fluid subsystem 120 on the reimageable surface 115, and optical patterning subsystem 130 may be used to selectively form a latent image in the uniform dampening fluid layer by image-wise patterning the dampening fluid layer using, for example, laser energy. The reimageable surface 115 of the imaging member 110 should ideally absorb most of the laser energy emitted from the optical patterning subsystem 130 close to the surface to minimize energy wasted in heating the dampening fluid and to minimize lateral spreading of heat in order to maintain a high spatial resolution capability. Alternatively, an appropriate radiation sensitive component may be added to the dampening fluid to aid in the absorption of the incident radiant laser energy. While the optical patterning subsystem 130 is described above as being a laser emitter, it should be understood that a variety of different systems may be used to deliver the optical energy to pattern the dampening fluid.

The mechanics at work in the patterning process undertaken by the optical patterning subsystem 130 of the exemplary system 100 are described in detail with reference to FIG. 5 in the 212 Publication. Briefly, the application of optical patterning energy from the optical patterning subsystem 130 results in selective evaporation of portions of the layer of dampening fluid.

Following patterning of the dampening fluid layer by the optical patterning subsystem 130, the patterned layer over the reimageable surface 115 is presented to an inker subsystem 140. The inker subsystem 140 is used to apply a uniform layer of ink over the layer of dampening fluid and the reimageable surface layer of the imaging member 110. The inker subsystem 140 may use an anilox roller to meter an offset lithographic ink onto one or more ink forming rollers that are in contact with the reimageable surface layer of the imaging member 110. The inker subsystem 140 may deposit the ink to the pockets representing the imaged portions of the reimageable surface 115, while ink deposited on the unformatted portions of the dampening fluid will not adhere based on a hydrophobic and/or oleophobic nature of those portions.

A cohesiveness and viscosity of the ink residing in the reimageable layer may be modified by a number of mechanisms. One such mechanism may involve the use of a rheology (complex viscoelastic modulus) control subsystem 150. The rheology control system 150 may form a partial crosslinking core of the ink on the reimageable surface 115 to, for example, increase ink cohesive strength relative to the reimageable surface layer. Curing mechanisms may include optical or photo curing, heat curing, drying, or various forms of chemical curing. Cooling may be used to modify rheology as well via multiple physical cooling mechanisms, as well as via chemical cooling.

The ink is then transferred from the reimageable surface 115 to a substrate of image receiving medium 114 using a transfer subsystem 160. The transfer occurs as the substrate 114 is passed through a transfer nip 112 between the imaging member 110 and an impression roller 118 such that the ink within the voids of the reimageable surface 115 is brought into physical contact with the substrate 114. The rheology control system 150 may increase adhesion of the ink, helping the ink to adhere to the substrate 114 and to separate from the reimageable surface of the imaging member 110. Careful control of the temperature and pressure conditions at the transfer nip 112 may allow transfer efficiencies to exceed 95%. While it is possible that some dampening fluid may also wet substrate 114, the volume of such a dampening fluid will be minimal, and will rapidly evaporate, or be absorbed by the substrate 114.

Following the transfer of the majority of the ink to the substrate 114 at the transfer nip 112, any residual ink and/or residual dampening fluid must be removed from the reimageable surface 115 to prepare the reimageable surface to repeat the digital image forming operation. This removal is most preferably undertaken without scraping or wearing the reimageable surface 115. An air knife or other like non-contact device may be employed to remove residual dampening fluid. It is anticipated, however, that some amount of ink residue may remain. Removal of such remaining ink residue may be accomplished through use of some form of cleaning subsystem 170. The 212 Publication describes details of such a cleaning subsystem 170 including at least a first cleaning member such as a sticky or tacky member in physical contact with the reimageable surface 115, the sticky or tacky member removing residual ink and remaining small amounts of surfactant compounds from the dampening fluid of the reimageable surface. The sticky or tacky member may then be brought into contact with a smooth roller to which residual ink may be transferred from the sticky or tacky member, the ink being subsequently stripped from the smooth roller by, for example, a doctor blade or other like device and collected as waste.

The 212 Publication details other mechanisms by which cleaning of the reimageable surface of the imaging member 110 may be facilitated. Regardless of the cleaning mechanism, however, cleaning of the residual ink and dampening fluid from the reimageable surface 115 is essential to preventing ghosting in subsequent image forming operations as the images change. Once cleaned, the reimageable surface 115 is again presented to the dampening fluid subsystem 120 by which a fresh layer of dampening fluid is supplied to the reimageable surface, and the process is repeated.

The previous cleaning subsystems and mechanisms have a problem during use of a loss of efficiency due to contamination of the cleaning member in physical contact with the reimageable surface of the imaging member. If too much ink contaminates the cleaning rollers, ink can re-transfer back onto the imaging member. Thus, residual ink that is transferred to the cleaning subsystem 170 must ultimately be removed from the cleaning rolls and transported into a waste container. Essentially, it's difficult to efficiently "clean" the cleaning roller or rollers.

The disclosed embodiments are examples intended to cover systems and methods for improved and efficient residual ink removal from an imaging member following the transfer of the majority of the ink from the imaging member to a substrate, and prior to the application of a fresh layer of dampening fluid to the reimageable surface of the imaging member. The examples include a cleaning apparatus having an inker roller and an ink source holding ink for the inker roller. The inker roller contacts the reimageable surface of an imaging member downstream of an ink image transfer station that transfers an ink image from the reimageable surface to a print sheet, with the reimageable surface of the imaging member having residual ink remaining thereon after the transfer of the ink image. The inker roller may be cylindrical with an outer surface textured to hold ink thereon for applying ink from the ink source against the reimageable surface. However, instead of the ink transferring from the inker roller to the reimageable surface, the ink stays with the inker roller as any surface tension between the ink and the reimageable surface is too low for ink splitting. The ink on the inker roller bonds with the residual ink, with their bond being a mechanical and/or chemical bond (e.g., adhesion, integration, attraction) there between. This bonding of the inks allows the inker roller to remove (e.g., separate, dislodge, pick up, transfer, pull) the residual ink from the reimageable surface and thereby clean the surface for a subsequent ink image. The inker roller is thus a cleaning inker roller that is not contaminated from picking up the residual ink as the inker roller is designed to be coated by ink that adds to its coating of ink via the picked up residual ink. In fact, the inks from the ink source and the ink image may be the same. This makes the cleaning inker roller a perpetual tacky roller configured to clean the reimageable surface, for example with the residual ink bonded with the ink from the inker roller transferring from the reimageable surface to the bonded ink on the inker roller upon rotation of the inker roller.

In examples the cleaning inker roller is an anilox roller that may maintain a constant ink thickness and residual ink removal tack force at the cleaning inker roller interface, for example via blade metering. In examples the cleaning apparatus may be temperature controlled, for example, with the inker roller and/or the ink source chilled to lower the temperature of the ink on the cleaning inker roller and thereby increase its surface energy and tackiness. In examples the cleaning apparatus works in conjunction with a pre-cleaner fountain solution applicator that applies fountain solution to non-residual-inked regions of the reimageable surface and prevents ink transfer from the cleaning inker roller to the reimageable surface. Further, the ink source may include a filter that separates the collected residual ink from the fountain solution. Here, the separated residual ink may be recycled for use with the cleaning inker roll, and the separated fountain solution may be recycled for use, for example, with the pre-clean fountain solution subsystem, or removed to a waste container.

Figure 2:
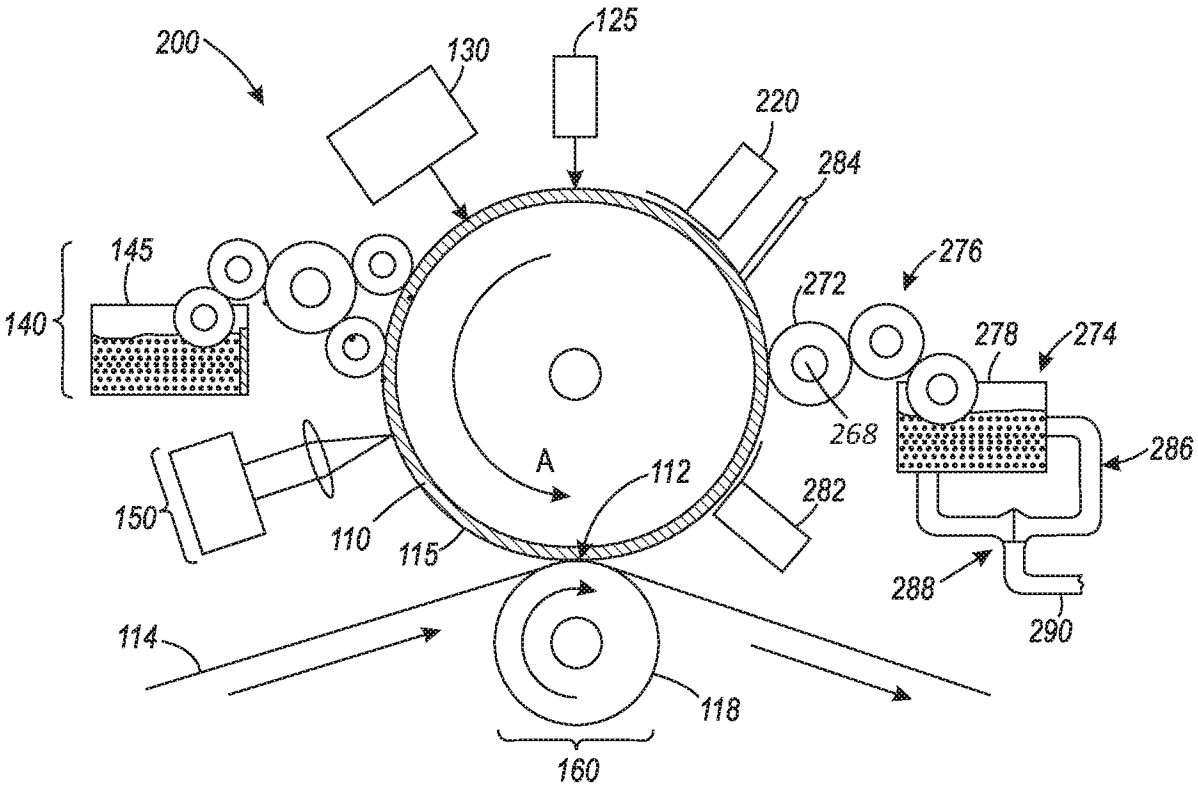
FIG. 2 is a side view of a variable lithographic printing system with a roller based cleaning station usable with a viscosity control unit in accordance with an example of the embodiments.

FIG. 2 illustrates a schematic representation of an exemplary embodiment of an ink-based digital printing system, including a variable data digital lithographic image forming device 200 according to this disclosure. As shown in FIG. 2, the variable data digital lithographic image forming device may be adapted to pattern a control/release agent (e.g., silicone oil) layer on a reimageable surface 115 of an imaging member 110 (e.g., pattern transfer drum, imaging blanket). Note that some description of components associated with the variable data lithography system shown in FIG. 1 may be omitted for brevity.

The exemplary system 200 includes a fountain solution applicator 220 as the dampening fluid subsystem 120 configured to deposit a layer of dampening fluid onto the surface 115. While not being limited to particular configuration, the exemplary fountain solution applicator 220 may include a series of rollers (FIG. 1) or sprays (FIG. 2) for uniformly wetting the reimageable surface 115 with a uniform layer of a fountain solution (e.g., dampening fluid), with the thickness of the layer being controlled. As noted above, the fountain solution may comprise water optionally with small amounts of isopropyl alcohol or ethanol added to reduce surface tension as well as to lower evaporation energy necessary to support subsequent laser patterning, as will be described in greater detail below. Low surface energy solvents such as volatile silicone oils can also serve as fountain solutions. A thickness of the fountain solution layer may be measured using a sensor 125 that may provide feedback to control the metering of the fountain solution onto the reimageable surface 115 by the fountain solution applicator 220.

The optical patterning subsystem 130 is located downstream the fountain solution applicator 220 in the printing processing direction to selectively pattern a latent image in the layer of fountain solution by image-wise patterning the fountain solution layer using, for example, laser energy. While the optical patterning subsystem 130 is described above as being a laser emitter, it should be understood that a variety of different systems may be used to deliver the optical energy to pattern the fountain solution.

Following patterning of the fountain solution layer by the optical patterning subsystem 130, the patterned layer over the reimageable surface 115 is presented to an inker subsystem 140. The inker subsystem 140 is positioned downstream the optical patterning subsystem to apply a uniform layer of ink over the layer of fountain solution and the reimageable surface layer of the imaging member 110. While not being limited to a particular configuration, the inker subsystem may use an anilox roller to meter an offset lithographic ink from an ink housing 145 onto the reimageable surface 115, either directly or via one or more ink forming rollers that are in contact with the reimageable surface 115. The inker subsystem 140 may deposit the ink to the pockets representing the imaged portions of the reimageable surface 115, while ink deposited on the unformatted portions of the fountain solution will not adhere based on a hydrophobic and/or oleophobic nature of those portions. The inker subsystem may heat the ink before it is applied to the reimageable surface 115 to lower the viscosity of the ink for better spreading into the imaged portion pockets of the reimageable surface. For example, one of the rollers of the inker subsystem may be heated, as well understood by a skilled artisan. The heated roller may be the anilox roller.

Although the ink may be discussed herein as a UV-curable ink, the disclosed embodiments are not intended to be limited to such a construct. The ink may be a UV-curable ink or another ink that hardens when exposed to UV radiation. The ink may be another ink having a cohesive bond that increases, for example, by increasing its viscosity. For example, the ink may be a solvent ink or aqueous ink that thickens when cooled and thins when heated.

Downstream the ink delivery unit in the printing process direction resides an ink image transfer station that transfers the ink image from the imaging member surface 115 to a substrate of image receiving medium 114. The transfer occurs as the substrate 114 is passed through a transfer nip 112 between the imaging member 110 and an impression roller 118 such that the ink within the voids of the reimageable surface 115 is brought into physical contact with the substrate 114.

As discussed above, despite previous best efforts, including the rheological conditioning system 150 that may increase the viscosity of the ink image before transfer of the ink image to the image receiving print media, not all of the ink may transfer to the substrate at the transfer nip 112. Thus, the reimageable surface of the imaging member will have residual ink remaining thereon after the transfer of the formed ink image. To maximize residual ink removal, an imaging member cleaning apparatus 270 depicted in FIG. 2 includes an inker roller 272 that removes the residual ink from the reimageable surface 115 prior to a delivery or deposit of a next ink image thereto by the inker subsystem 140, and an ink source 274 holding ink for transfer to the inker roller. The inker roller 272 is shown having ink thereon for rolling contact with the reimageable surface 115, with the inker roller configured to remove the residual ink from the reimageable surface by carrying the ink from the ink source 274 to the imaging member 110 and contacting (e.g., physically touching) the carried ink against the residual ink to transfer the residual ink from the reimageable surface 112 to the inker roller at a nip between the inker roller and the reimageable surface. The inker roller 272 is thus a cleaner roll, even though it applies ink against the reimageable surface 215. Further, the inker roller 272 and ink source 274 are also considered as at least part of an ink deliver unit, since the inker roller delivers ink to the reimageable surface. However, the delivered ink on the inker roller rolling against the reimageable surface does not adhere to the reimageable surface. Instead, it remains with the inker roller 272 and removes residual ink from the reimageable surface.

The inker roller 272 maybe one of a plurality of rollers 276 between the ink source 274 and the reimageable surface 115 configured to convey ink from the ink source to the reimageable surface 115, with the inker roller 272 brought into contact with the reimageable surface. One of the plurality of rollers maybe an anilox roller designed to meter ink onto the reimageable surface 115, either directly or via one or more ink forming rollers that are in contact with the reimageable surface 115. The inker roller 272 may be the anilox roller, as the anilox roller has a surface for controlling ink thickness (e.g., via blade metering) At least one of the plurality of rollers may be chilled to lower the temperature of the ink, as will be described in greater detail below.

The ink source 274 may include a housing 278 designed to store the ink used by the inker roller 272 to clean the reimageable surface 115. The housing allows ink access to the rollers 276 as needed for this purpose. The ink maybe the same ink or the same type of ink that is applied to the reimageable surface by the inker subsystem 140. Inks of the same type are understood to include same type by composition (e.g., chemical substances, concentration of chemical substances in the composition, components, dye components, pigment components, color), by ink type (aqueous, non-aqueous, UV, UV-curable, solvent, magnetic) or other types of ink as understood by a skilled artisan. Ink used by the inker roller 272 may be considered the same type of ink as the ink applied by the inker subsystem 140 even if it includes some minor amount of fountain solution and contaminants (e.g., paper debris, dust, air particles) picked up from the reimageable surface 115.

The imaging member cleaning apparatus 270 may chill the ink on the inker roller to a temperature lower than a temperature of the ink deposited on the reimageable surface by the inker subsystem. In particular, at least one of the housing 278 and rollers 276 may include a cooler 268, such as any device configured to lower the temperature of its immediate environment as well understood by a skilled artisan. While not being limited to a particular theory, FIG. 2 shows the inker roller 272 as a chilled roller, for example, via a chilled gas within the roller that lowers the surface temperature of the inker roll, and the ink thereon. The cooled ink has a higher viscosity and a higher surface tension than the ink that is applied to the reimageable surface by the inker subsystem 140 and forms the ink image. The cooled ink thus has a higher adhesion than the residual ink, allowing the cooled ink to stay on the inker roller 272 while cohesively bonding with the residual ink at a nip 280 between the inker roller and the reimageable surface 115, with the inker roller conveying the cooled ink against the reimageable surface. The inker roller 272 thus functions as a perpetual tacky roller to remove residual ink from the reimageable surface. Contamination of the ink covered tacky roller is not an issue since ink is used to remove the residual ink.

The imaging member cleaning apparatus 270 may further include a pre-clean fountain solution subsystem 282 positioned between the image transfer mechanism and the inker roller 272. The pre-clean fountain solution subsystem 282 is designed to deposit a post-image transfer layer of fountain solution onto the reimageable surface 115. In this manner the pre-clean fountain solution subsystem 282 is at least substantially similar to the fountain solution applicator 220. For example, the pre-clean fountain solution subsystem may include a series of rollers (FIG. 1) or sprays (FIG. 2) for uniformly wetting the reimageable surface 115 with a uniform layer of a fountain solution (e.g., dampening fluid), with the thickness of the layer being controlled. With residual ink remaining on the reimageable surface 115, the pre-clean fountain solution applies fountain solution to the non-inked regions of the blanket and prevents ink transfer in those regions. That is, the ink on the inker roller 272 is even more likely to stay on the inker roller where the layer of pre-clean fountain solution lays on the reimageable surface. However, the fountain solution does not inhibit the ink on the inker roller 272 from bonding with and transferring the residual ink from the reimageable surface to the inker roller. The fountain solution applied by the pre-clean fountain solution subsystem 282 and the fountain solution applicator 220 may be the same.

The layer of fountain solution applied by the pre-clean fountain solution subsystem may be thinner than the layer applied by the fountain solution applicator, at least due to the layer of pre-clean fountain solution desired to remain on the reimageable surface 115 for a relatively short duration compared to the layer of fountain solution applied by the fountain solution applicator. The pre-clean fountain solution remaining on the reimageable surface after the inker roller 272 may be minimized so it does not affect the evenness of the layer of fountains solution applied by the fountain solution applicator 220. Therefore it may be beneficial to have a layer of the pre-clean fountain solution sufficiently thin to remain on the reimageable surface thought he nip 280. Any excess pre-clean fountain solution may be evaporated or otherwise removed from the reimageable surface 115 via an air knife 284 for example, as can be seen in FIG. 2.

In addition to residual ink remaining on the reimageable surface 115 of the imaging member 110, paper debris from image receiving print media 114 may adhere to the image member after transfer. The inker roller 272 also picks up such paper debris and other contaminants, with the ink on the inker roller forming the tacky surface thereof. Residual ink picked up by the ink-covered inker roller 272 may remain on the inker roller and mix with the ink on the inker roller for use as the tacky surface of the inker roller. Accordingly, residual ink can be used by the inker roller and then used to pick up subsequent residual ink from the reimageable surface 115. The collected residual ink, paper debris and pre-clean fountain solution picked up by the ink-covered inker roller 272 may be transferred via rollers 276 to the ink source 274. The residual ink may combine with ink stored in the ink source housing 278 for transfer via rollers 276 to the inker roller 272 as needed to maintain a consistent layer of ink on the inker roller as the tacky surface for cleaning the reimageable surface 115.

Over time, the pre-clean fountain solution and paper debris collected by the cleaning apparatus 270 may compromise the ink composition, which may decrease the ability of the ink in the ink housing 278 as the tacky surface of the inker roller 278. So it may be beneficial to remove fountain solution and other contaminants picked up by the inker roller from the ink stored in the ink housing. The ink source 274 may include an ink recirculation system 286 having a filter 288 that separates the fountain solution and contaminants from the ink, with the filtered ink remaining in or recycled back to the ink housing 278, and the fountain solution and contaminants removed (e.g., via outlet 290) to a waste container (not shown). Of course, overflow ink may also be removed to a waste container, as well understood by a skilled artisan.

It should be noted that fountain solution may not be needed where the ink rheology of the ink on the inker roller 272 is sufficient to prevent ink deposition to regions of the reimageable surface 115 absent of residual ink. Of course the rheology difference between the ink on the inker roller 272 and the ink deposited by the inker subsystem 140 increases as the temperature difference increases, for example, by cooling the ink on the inker roller 272.

Figure 3:
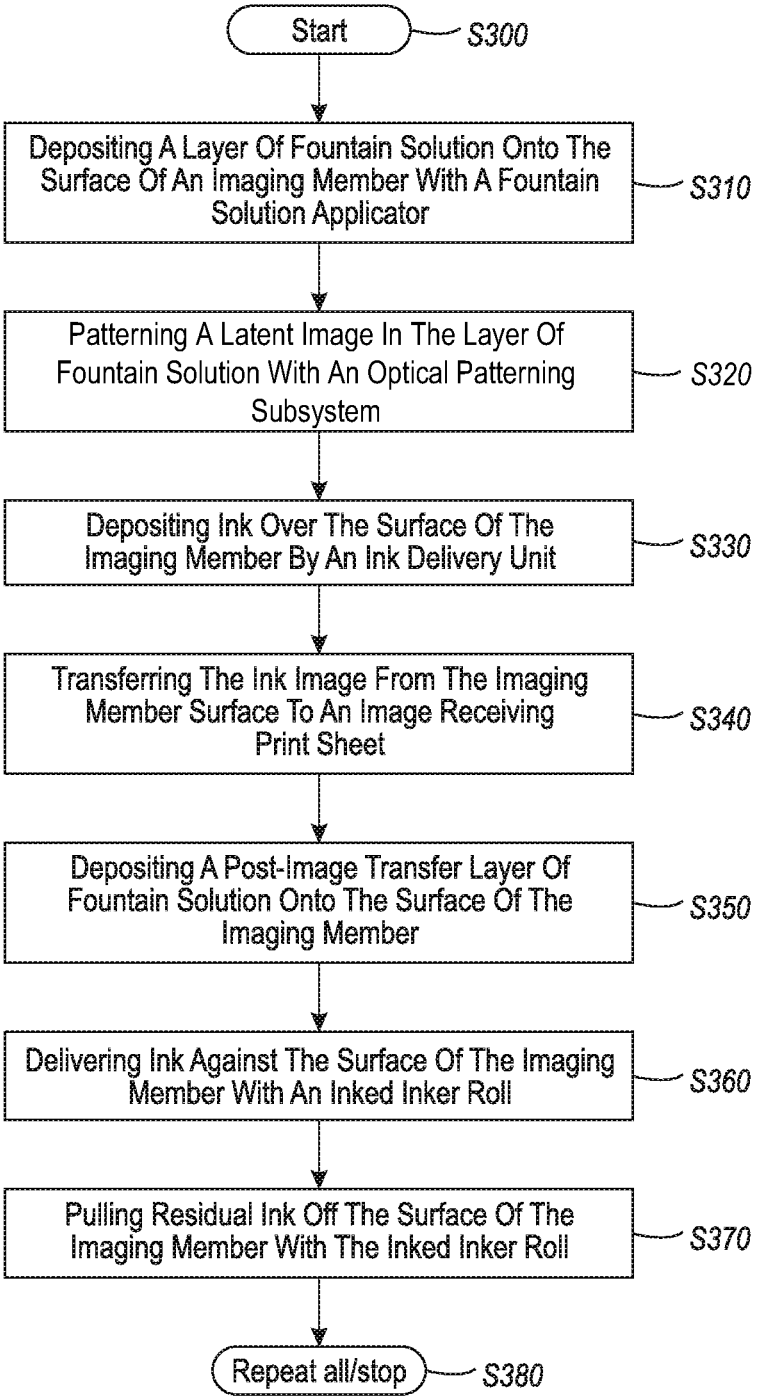
FIG. 3 is a flowchart depicting the operation of an exemplary variable lithographic printing system.

The disclosed embodiments may include an exemplary ink-based digital printing cleaning method implementing a variable data deposition and image forming process with a residual ink cleaning device/technique. FIG. 3 illustrates a flowchart of such an exemplary method. As shown in FIG. 3, operation of the method commences at Step S300 and proceeds to Step S310.

In Step S310, a layer of fountain solution may be deposit onto the surface of an imaging member with a fountain solution applicator. The surface of the imaging member may be a reimageable conformable surface layer including a fluoroelastomer. Operation of the method proceeds to Step S320, where a latent image may be selectively patterned in the layer of fountain solution with an optical patterning subsystem located downstream the fountain solution applicator in the printing processing direction. Operation of the method proceeds to Step S330.

In Step S330, an ink may be deposited over a reimageable surface of the imaging member by an ink delivery unit located downstream the optical patterning subsystem to form an ink image. Operation of the method proceeds to Step S340, where the ink image may be transferred from the imaging member surface to an image receiving print sheet via an ink image transfer station positioned downstream of the ink delivery unit in the printing process direction, this operation may leave residual ink on the imaging member surface after the transfer of the formed ink image. Operation of the method proceeds to Step S350.

In Step S350, a post-image transfer layer (e.g., second layer) of fountain solution is deposited onto the reimageable surface of the imaging member. The fountain solution spreads to the non-inked regions of the reimageable surface absent residual ink. Operation the method proceeds to Step S360.

In Step S360, ink is delivered against the reimageable surface of the imaging member with an inked inker roller to clean the surface. The inked inker roller may be positioned downstream of the ink image transfer station in the printing process direction. Operation of the method proceeds to Step S370, where residual ink is removed (e.g., separated, dislodged, picked up, transferred, pulled) from the reimageable surface with the inked inker roller, for example with the residual ink bonded with the ink from the inker roller transferring from the reimageable surface to the bonded ink on the inker roller upon rotation of the inker roller. Operation the method may cease at Step S380, or may repeat back to Step S310, where a new layer of fountain solution may be deposited onto the surface of an imaging member.

The above-described exemplary systems and methods may reference certain conventional image forming device components to provide a brief, background description of image forming approaches that may be adapted to carry into effect the variable data digital control/release agent layer deposition processes in support of the disclosed schemes. No particular limitation to a specific configuration of the imaging member cleaning apparatus is to be construed based on the description of the exemplary elements depicted and described above.

Those skilled in the art will appreciate that other embodiments of the disclosed subject matter may be practiced with many types of image forming elements common to lithographic image forming systems in many different configurations. It should be understood that these are non-limiting examples of the variations that may be undertaken according to the disclosed schemes. In other words, no particular limiting configuration is to be implied from the above description and the accompanying drawings.

The exemplary depicted sequence of executable method steps represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 3, and the accompanying description, except where any particular method step is reasonably considered to be a necessary precondition to execution of any other method step. For example, the ink delivery step S360 occurs after the image transfer step S340 and before the residual ink is removed from the imaging member surface at step S370. Individual method steps may be carried out in sequence or in parallel in simultaneous or near simultaneous timing. Additionally, not all of the depicted and described method steps need to be included in any particular scheme according to disclosure. As an illustrated example, an ink image may be printed and transferred to paper according to Steps S300-S350. After one image imaging member revolution, the imaging member may continue with a second revolution without the image patterning Step S320 The ink delivery unit used in Step S330 may then be used here for Steps S360 and S370 to clean the surface of the imaging member.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. An imaging member cleaning apparatus, comprising:

an inker roller having ink thereon for contact with an imaging member downstream of both an ink delivery device and an ink image transfer station in a printing process direction, the ink delivery device configured to deposit ink over a reimageable surface of the imaging member to form an ink image thereon, the ink image transfer station configured to transfer the ink image from the reimageable surface to a print sheet, with the reimageable surface of the imaging member having residual ink remaining thereon after the transfer of the ink image at the ink image transfer station; and an ink source holding ink for transfer to the inker roll, with the inker roller configured to remove the residual ink from the reimageable surface by carrying the ink from the ink source to the imaging member and contacting the carried ink against the residual ink to clean the reimageable surface.

2. The imaging member cleaning apparatus of claim 1, further comprising a cooler configured to cool the ink on the inker roller to a temperature lower than a temperature of the ink deposited on the reimageable surface by the inking delivery device, the inker roller rolling the cooled ink thereon against the reimageable surface at a nip between the inker roller and the imaging member.

3. The imaging member cleaning apparatus of claim 2, wherein the inker roller is a chilled anilox roll, the cooled ink on the inker roller having a viscosity higher than a viscosity of the ink deposited on the reimageable surface by the inking delivery device.

4. The imaging member cleaning apparatus of claim 1, further comprising a pre-clean fountain solution subsystem positioned downstream of the ink image transfer station and upstream the inker roller in the printing process direction, the pre-clean fountain solution subsystem configured to deposit a layer of fountain solution onto the reimageable surface between the residual ink thereon.

5. The imaging member cleaning apparatus of claim 1, the ink in the ink source being the same ink type as the ink deposited on the reimageable surface by the inking delivery device.

6. The imaging member cleaning apparatus of claim 1, the ink source including an ink filter configured to separate the ink from the fountain solution deposited onto the reimageable surface by the pre-clean fountain solution subsystem, with the filtered ink remaining in the ink source.

7. An ink-based digital printing system, comprising:

an imaging member having a reimageable surface;

an ink delivery device including a first ink source, with the ink delivery device configured to deposit a first ink over the reimageable surface to form an ink image, an ink image transfer station positioned downstream of the ink delivery device in a printing process direction that transfers the ink image from the reimageable surface to an image receiving print sheet, the reimageable surface having residual ink remaining on the surface after the transfer of the formed ink image;

a second ink delivery device in contact with the reimageable surface of the imaging member downstream of the ink image transfer station in the printing process direction the second ink delivery device including a second ink source, with the second ink delivery device configured to remove the residual ink from the reimageable surface by carrying a second ink from the second ink source to the imaging member and contacting the second ink against the residual ink to clean the reimageable surface.

8. The ink-based digital printing system of claim 7, wherein the second ink is the same ink type as the first ink.

9. The ink-based digital printing system of claim 7, the second ink delivery device being an imaging member cleaning apparatus having an inker roller in rolling contact with the reimageable surface, the second ink delivery device configured to cool the second ink to a temperature lower than a temperature of the first ink, the inker roller rolling the cooled second ink against the reimageable surface at a nip between the inker roller and the imaging member.

10. The ink-based digital printing system of claim 9, wherein the inker roller is a chilled anilox roll, and the cooled second ink has a viscosity higher than a viscosity of the first ink.

11. The ink-based digital printing system of claim 7, further comprising a pre-clean fountain solution subsystem positioned downstream of the ink image transfer station and upstream the second ink delivery device in the printing process direction, the pre-clean fountain solution subsystem configured to deposit a pre-clean layer of fountain solution onto the reimageable surface between the residual ink thereon.

12. The ink-based digital printing system of claim 7, the second ink source including an ink filter configured to separate the second ink from the fountain solution deposited onto the reimageable surface by the pre-clean fountain solution subsystem, with the filtered second ink remaining in the second ink source.

13. The ink-based digital printing system of claim 5, further comprising a post-cleaner fountain solution subsystem positioned downstream the second ink delivery device and upstream the ink delivery device in the printing processing direction, the fountain solution subsystem configured to deposit a post-cleaner layer of fountain solution onto the reimageable surface of the imaging member.

14. The ink-based digital printing system of claim 13, wherein the pre-clean layer of fountain solution is thinner than the post-cleaner layer of fountain solution.

15. The ink-based digital printing system of claim 7, the ink delivery device including an anilox roller configured to meter the first ink from the first ink source onto the reimageable surface, the second ink delivery device including a second anilox roller configured to meter the second ink from the second ink source to the reimageable surface at a nip between the second anilox roller and the imaging member, the second ink remaining with the second anilox roller after the nip.

16. The ink-based digital printing system of claim 7, further comprising:

a post-cleaner fountain solution subsystem positioned downstream the second ink delivery device and upstream the ink delivery device in the printing processing direction, the post-cleaner fountain solution subsystem configured to deposit a post-cleaner layer of fountain solution onto the reimageable surface of the imaging member;

an optical patterning subsystem between the post-cleaner fountain solution subsystem and the ink delivery device in the printing processing direction, the optical patterning subsystem configured to selectively pattern a latent image in the layer of fountain solution, the ink delivery device configured to deposit the ink on the latent image to form the ink image.

17. An ink-based digital printing cleaning method, comprising:

depositing ink over a reimageable surface of an imaging member with an ink delivery unit to form an ink image, transferring the ink image from the reimageable surface to an image receiving print sheet via an ink image transfer station positioned downstream of the ink delivery unit in a printing process direction, the reimageable surface having residual ink remaining on the surface after the transfer of the formed ink image;

delivering ink against the reimageable surface of the imaging member with an inked inker roller downstream of the ink image transfer station in the printing process direction; and removing the residual ink from the reimageable surface with the ink on the inker roller.

18. The method of claim 17, further comprising increasing the viscosity of the ink on the inker roller prior to contact with the reimageable surface to a viscosity greater than a viscosity of the ink deposited on the reimageable surface by the inking delivery device.

19. The method of claim 18, the step of increasing the viscosity of the ink on the inker roller including cooling the ink on the inker roller to a temperature lower than a temperature of the ink deposited on the reimageable surface by the inking delivery device.

20. The method of claim 17, further comprising depositing a layer of fountain solution onto the reimageable surface between the residual ink thereon with a pre-clean fountain solution subsystem positioned downstream of the ink image transfer station and upstream the inker roller in the printing process direction.

* * * * *